US005167917A

United States Patent [19]

Sugitani

[11] Patent Number: 5,167,917

[45] Date of Patent: Dec. 1, 1992

[54] MAGNESIUM ALLOY FOR USE IN CASTING AND HAVING A NARROWER SOLIDIFICATION TEMPERATURE RANGE

[75] Inventor: Nobuhiro Sugitani, Tokyo, Japan

[73] Assignee: Sugitani Kinzoku Kogyo Kabushiki Kaisha, Tokyo, Japan

[21] Appl. No.: 726,906

[22] Filed: Jul. 8, 1991

[30] Foreign Application Priority Data

Sep. 21, 1990 [JP] Japan ..... 2-250076

[51] Int. Cl.[5] ..... C22C 23/00

[52] U.S. Cl. ..... 420/405; 420/411

[58] Field of Search ..... 420/405, 411

[56] References Cited

U.S. PATENT DOCUMENTS

| | | | |
|---|---|---|---|
| 3,024,108 | 3/1962 | Foerster | 420/405 |
| 3,334,998 | 8/1967 | Fisher | 420/405 |
| 4,938,809 | 7/1990 | Das et al. | 148/406 |

FOREIGN PATENT DOCUMENTS

| | | | |
|---|---|---|---|
| 899050 | 5/1945 | France . | |
| 2336491 | 7/1977 | France . | |
| 472771 | 9/1937 | United Kingdom . | |
| 607588 | 9/1948 | United Kingdom . | |
| 0775150 | 5/1957 | United Kingdom | 420/405 |

*Primary Examiner*—Upendra Roy

*Attorney, Agent, or Firm*—Kane, Dalsimer, Sullivan, Kurucz, Levy, Eisele and Richard

[57] ABSTRACT

A magnesium alloy for use in casting is disclosed herein, which contains zinc and a rare earth metal component and has a solidification temperature range of at most 50° C. The magnesium alloy comprises 8.5 to 1.9 % by weight of a rare earth metal mixture consisting essentially of cerium and lanthanum as the rare earth metal component, 6.4 to 4.2% by weight of zinc, and the balance of magnesium, based on the total weight of the magnesium alloy.

1 Claim, No Drawings

MAGNESIUM ALLOY FOR USE IN CASTING AND HAVING A NARROWER SOLIDIFICATION TEMPERATURE RANGE

BACKGROUND OF THE INVENTION

1. Field of the Invention

The present invention relates to a magnesium alloy improved in castability by having a narrower solidification temperature range of at most 50° C.

2. Description of the Prior Art

Magnesium alloys are lightweight, and some magnesium alloys have sufficient strength. However, the magnesium alloys have a wider solidification temperature range, i.e., a wider solid-liquid coexistence temperature range. For this reason, they are liable to produce cracks in casting, and particularly, it is difficult to produce a large-sized product in a casting manner. Therefore, no prior art has succeeded in industrially carrying out the manufacture of a relatively large-sized cast product made of a magnesium alloy in spite of the many efforts by those skilled in the art.

SUMMARY OF THE INVENTION

Accordingly, it is an object of the present invention to provide a magnesium alloy suitable for use in casting and having a narrower solidification temperature range so that the casting thereof can be easily carried out and no cracks will be produced in it.

The present inventors have found that the above object can be achieved by providing a magnesium alloy containing a specified amount of zinc and a specified amount of a rare earth metal mixture having a specified composition.

Thus, according to the present invention, there is provided a magnesium alloy for use in casting, which contains zinc and a rare earth metal component and has a solidification temperature range of at most 50° C., said magnesium alloy comprising 8.5 to 1.9% by weight of a rare earth metal mixture consisting essentially of cerium and lanthanum as the rare earth metal component, 6.4 to 4.2% by weight of zinc, and the balance of magnesium, based on the total weight of the magnesium alloy.

The rare earth metal mixture contained in the alloy of the present invention may consist essentially of cerium and lanthanum, but it is particularly preferable that the mixture consists of at least 55% by weight of cerium, at least 18% by weight of lanthanum, and the balance of praseodymium and/or neodymium, based on the total weight of the mixture.

With the magnesium alloy of the present invention, it is possible to suppress production of cracks which may often be produced with the prior art magnesium alloy and to produce a lightweight magnesium alloy product in a casting manner regardless of the size. This significantly contributes to the development of the industry.

DETAILED DESCRIPTION OF THE INVENTION

The magnesium alloy according to the present invention is suitable for use in a metal mold casting including lower pressure casting, die casting and the like.

Even if the contents of cerium and lanthanum are beyond the abovedescribed ranges, it is possible to provide a solidification temperature range narrowed down to some extent, but within the above ranges, a particularly narrower solidification temperature range being able to be achieved (see Comparative Example 3). If the mount of the rare earth metal mixture contained in the magnesium alloy of the present invention is out of the above-defined range, a resulting magnesium alloy has a significantly widened solidification temperature range and hence, it is impossible to achieve the object of the present invention (see Comparative Example 1).

The zinc contained in the magnesium alloy of the present invention serves to improve the castability of the magnesium alloy. If the content of zinc is less than the above range, a resulting magnesium alloy exhibits a insufficient castability (see Comparative Example 2). If the content of zinc is more than the above-defined range, a resulting magnesium alloy has a considerably increased solidification temperature range and a reduced mechanical strength.

The magnesium alloy for use in casting according to the present invention can be produced by a process known for an alloy containing a rare earth metal.

The present invention will now be described in detail by way of of Examples and Comparative Examples.

EXAMPLES

As used in the following Examples and Comparative Examples, % is by weight, unless it is otherwise defined.

Example 1

3 Parts by weight of granular cerium (having a purity of 92.2%) is mixed with 2 parts by weight of a granular misch metal free of cerium (having a lanthanum content of 46.0%). The mixture has a composition of 55.4% of Ce, 19.2% of La, 14.6% of Nd and 5.0% of Pr, the balance consisting of impurities such as Fe, Si, Cr and the like.

250 Grams of the rare earth metal mixture and 450 grams of a zinc piece are added to 9,300 grams of molten magnesium at about 680° C. and melted.

The resultant molten material is poured into a mold for an oil pump body having the following dimensions and a bottle gourd-shaped crosssection having two opened holes of the same size (R 50 mm) are provided in two raised portions of the bottle gourd shape):

| | | | |
|---|---|---|---|
| Maximum width | 250 mm | Minimum width | 80 mm |
| Height | 100 mm | Diameter of hole | 40 mm |
| Distance between centers of two holes | | 150 mm | |

The solidification of the molten material was started from about 540° C. and completed at about 500° C. Therefore, the solidification temperature range was about 40° C. The material was subjected to an artificial aging at a temperature of 200° C. for 5 hours.

Ten cast products of the same type were produced in the same manner, and as a result, there were no cracks and no surface depressions produced in any of the cast products.

Comparative Example 1

Using the same rare earth metal mixture as in Example 1, a similar oil pump body was produced in the same manner as in Example 1, except that 100 g of the rare earth metal, 450 g of zinc and 9,450 g of magnesium were used.

Ten similar cast products were produced using this magnesium alloy, and there were cracks produced in two of the cast products. The solidification behavior was as follows:

Solidification starting temperature: about 610° C.
Solidification finishing temperature: about 530° C.
Solidification temperature range: about 80° C.

Comparative Example 2

Using the same rare earth metal mixture as in Example 1, a similar oil pump body was produced in the same manner as in Example 1, except that 150 g of the rare earth metal, 250 g of zinc and 9,600 g of magnesium were used.

Ten similar cast products were produced using this magnesium alloy, and there were cracks and surface depressions produced in two of the cast products. With the magnesium alloy in Comparative Example 2, the viscosity of the molten metal during casting was too high, and it was difficult to pour the molten metal for casting. The solidification behavior was as follows:
Solidification starting temperature: about 620° C.
Solidification finishing temperature: about 550° C.
Solidification temperature range: about 70° C.

Comparative Example 3

A magnesium alloy was produced in the same manner as in Example 1, and an oil pump body was produced in the same manner as in Example 1, except for the use of a rare earth metal having a composition consisting of 40.6% of Ce, 19.8% of La, 29.0% of Nd and 6.7% of Pr, the balance consisting of impurities such as Fe, Si, Cr and the like.

The amounts of the rare earth metal mixture, zinc and magnesium and the process are as defined in Example 1. Ten similar cast products were produced using such a magnesium alloy. There were cracks produced in one of the cast products, and surface depressions produced in two of the cast products. The solidification behavior was as follows:
Solidification starting temperature: about 560° C.
Solidification finishing temperature: about 480° C.
Solidification temperature range: about 80° C.

What is claimed is:

1. A magnesium alloy for use in casting, which contains zinc and a rare earth metal component, characterized by having a solidification temperature range of at most 50° C., and comprising 8.5 to 1.9% by weight of a rare earth metal mixture, 6.4 to 4.2% by weight of zinc, and the balance of magnesium, based on the total weight of the magnesium alloy, wherein said rare earth metal mixture consisting of at least 55% by weight of cerium, at least 18% by weight of lanthanum, and the balance of praseodymium and/or neodymium, based on the total weight of the mixture.

* * * * *